US005683840A

United States Patent [19]

Tam et al.

[11] Patent Number: 5,683,840

[45] Date of Patent: Nov. 4, 1997

[54] METHOD AND APPARATUS FOR GROUNDING MIGRATION IMAGING MEMBERS

[75] Inventors: Man C. Tam; Edward G. Zwartz; Daniel Bihon, all of Mississaugua, Canada; Robert J. Kleckner, Yorktown Heights, N.Y.

[73] Assignee: Xerox Corporation, Stamford

[21] Appl. No.: 632,333

[22] Filed: Apr. 11, 1996

[51] Int. Cl.[6] ..... G03G 13/04

[52] U.S. Cl. ..... 430/41; 430/130

[58] Field of Search ..... 430/41, 130

[56] References Cited

U.S. PATENT DOCUMENTS

| | | | |
|---|---|---|---|
| 3,533,692 | 10/1970 | Blanchette et al. | 355/16 |
| 3,552,957 | 1/1971 | Hodges | 96/1.5 |
| 3,639,121 | 2/1972 | York | 96/1.5 |
| 3,684,503 | 8/1972 | Humphriss et al. | 96/1.5 |
| 3,910,475 | 10/1975 | Pundsack et al. | 226/6 |
| 4,040,826 | 8/1977 | Goffe et al. | 430/41 |
| 4,081,273 | 3/1978 | Goffe | 430/41 |
| 4,120,720 | 10/1978 | Gross | 96/1.5 |
| 5,215,838 | 6/1993 | Tam et al. | 430/41 |
| 5,563,013 | 10/1996 | Tam | 430/41 |

*Primary Examiner*—John Goodrow

[57] ABSTRACT

Methods and techniques of electrically biasing and providing a ground for migration imaging members are disclosed. An electrically conductive contact is fixed to the migration imaging member, the electrically conductive contact connecting at least an electrically conductive layer of the migration imaging member to a ground to insure proper imaging. The contacts are fixed to the migration imaging member without having to remove a portion of the softenable layer along its edge to expose the electrically conductive layer of the migration imaging member as is the current practice.

20 Claims, 4 Drawing Sheets

METHOD AND APPARATUS FOR GROUNDING MIGRATION IMAGING MEMBERS

This invention relates generally to a migration imaging member, and more particularly concerns techniques and processes for grounding migration imaging members.

BACKGROUND

Migration imaging members can be used in the Graphic Arts Industry as a film intermediate replacement for silver halide film. The use of chemicals, disposability of chemicals such as spent developers and fixers and the shelf life of the chemicals and film are issues with silver halide development. The dry heat development process used in certain types of migration imaging member does not require chemicals, unlike conventional silver halide film. Therefore the replacement of silver halide film with migration imaging member is very desirable.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured measured for the purpose of this invention by diffuse densitometers with a blue filter which conforms to ANSI PH 2.19 status T response. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone.

Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 and U.S. Pat. No. 4,536,457.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

Proper grounding of the migration imaging member is necessary for acceptable imaging results. Presently migration imaging members either have a ground plane in the form of a conductive layer left exposed during the manufacturing process, or have layers of the member removed by solvent to expose the ground plane for use.

In the manufacturing process, migration imaging members are typically coated at 60 inch web widths. If an exposed ground plane is required, only the outer edges of the web could easily remain uncoated to provide the necessary grounding connections. Otherwise, complicated and costly coating procedures are required to produce manufactured film with exposed aluminum edges from center sections of cut film. Alternatively a manufacturing/film packaging step must be used to effectively remove the coated structure without damaging the continuity of the ground plane. The challenge is to provide electrical contact to the inner film regions when cut down to customer required widths, to thereby minimize film wastage. Ideally, no exposed ground plane is required so that the film can be imaged edge to edge. Imaging tests in the laboratory allow the use of solvents to carefully remove small areas of the migration imaging member, exposing the ground plane without removing aluminum. Once the aluminum surface is exposed, a conductive copper tape connects the aluminum layer to ground. Dry heat migration imaging members do not use chemicals to process images. The use of solvents in part of the process is not only time consuming either at the manufacturing site or at the customer site but also results in environmental pollutants.

The following disclosures may be relevant to various aspects of the present invention:

- U.S. Pat. No. 3,533,692 Inventor: Blanchette et al. Issued: Oct. 13, 1970
- U.S. Pat. No. 3,552,957 Inventor: Hodges Issued: 3,552,957
- U.S. Pat. No. 3,639,121 Inventor: York Issued: Feb. 1, 1972
- U.S. Pat. No. 3,684,503 Inventor: Humphriss et al. Issued: Aug. 15, 1972
- U.S. Pat. No. 3,910,475 Inventor: Pundsack et al. Issued: Oct. 7, 1975
- U.S. Pat. No. 4,120,720 Inventor: Gross Issued: Oct. 17, 1978
- U.S. Pat. No. 5,215,838 Inventor: Tam et al. Issued: Jun. 1, 1993

The relevant portions of the foregoing disclosures may be briefly summarized as follows:

U.S. Pat. No. 3,533,692 discloses a multi-layer photoconductive belt made up of a first layer of highly insulating material over which is applied a conductive layer followed by the photoconductive material. The conductive layer of the belt, which is aluminum, is exposed along a lateral edge so that a contact rides on the exposed edge connecting the conductive layer to ground potential or alternatively can have a voltage applied to the layer. The rotating belt is thereby continually connected to ground so that the electrostatic charges can leak off along a conductive path upon exposure to electromagnetic radiation. In another embodiment the conductive layer is connected by a metallic plug or strap to a metallic strip on the underside of the insulating layer which makes continual contact with a conductive drive roller which then can be connected to ground or alternatively to a potential source. By means of maintaining such a continuous connection the applicator roll of the developer and the transfer roller at the transfer station station operate under conditions in which a potential gradient is applied between the particular roller and the conductive backing of the photoconductive medium.

U.S. Pat. No. 3,552,957 teaches a photoconductive member carrying a broad clamp which is preassembled in permanent nonfracturing electrical contact with an extremely thin conductive layer of the member and providing an electrical and mechanical coupling between the conductive layer and the electrophotographic apparatus. The clamp may contain mounting perforations to facilitate physical attachment to the apparatus.

U.S. Pat. No. 3,639,121 teaches electrically conducting lacquers coated on the edge of electrophotographic elements to maintain conducting layers at ground potential during charging by providing an electrical path from the conducting layer to a ground. Typical conducting lacquers include mixtures of electrically conducting carbon black and graphite in a polymeric resin binder.

U.S. Pat. No. 3,684,503 discloses an electrophotographic element having a non-recording portion distributed through it in the form of an electrically conductive solid dispersion. The dispersion extends from an external surface of the element to the electrically conducting layer to provide grounding for the layer while charging. Typical dispersions are formed from any electrically conducting material dispersed in a polymeric binder in the element.

U.S. Pat. No. 3,910,475 teaches a system for electrically grounding a migration imaging member having an insulating layer and a conductive layer and at least one indent in and through the insulating layer and contacting a grounded element through the indent so that the member is grounded. The indents in the member also allow the member to be advanced by the ground elements which move in and out of the indents.

U.S. Pat. No. 4,120,720 discloses an electrophotographic recording member having an electrically conductive substrate sandwiched between two electrically insulating substrates. A ground connection is established with the intermediate conductive layer by a hole through the recording member and a conductive lacquer coating on the inner surface of the hole.

U.S. Pat. No. 5,215,838 teaches a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

U.S. patent application entitled "Improved Migration Imaging Members" (D/95446) discloses a migration imaging member which comprises (a) a substrate, (b) a conductive layer comprising indium tin oxide dispersed in a polymeric binder, (c) a siloxane film charge blocking layer and (d) a softenable layer comprising a softenable material and a photosensitive migration marking material. Optionally an antistatic layer comprising indium tin oxide dispersed in a polymeric binder is situated on the surface of the substrate spaced from the softenable layer.

All of the above references are hereby incorporated by reference.

SUMMARY

In accordance with one aspect of the present invention, there is provided a migration imaging member having a substrate, a conductive layer and a softenable layer composed of a softenable material and a photsensitive migration marking material that has the softenable coextensive with the conductive layer and an electrically biasing element affixed to the migration imaging member. The electrically biasing element connects the conductive layer to the bottom surface of the migration imaging member.

Pursuant to another aspect of the present invention, there is provided a method of making a grounded migration imaging member including a conductive layer located between a substrate and a softenable layer composed of a softenable material and a photosensitive migration marking material comprising the steps of applying the softenable layer over the condcutive layer so that the softenable layer is coextensive with the conductive layer and electrically connecting the conductive layer to the bottom surface of the migration imaging member while the softenable layer and the conductive layer remain coextensive.

There are many advantages to producing a migration imaging member according to the present invention. The invention avoids the requirement that the ground plane be exposed during production where edge to edge imaging is desired, resulting in reduced manufacturing film losses. Another advantage is that there are no solvents used in processing the film, making the migration imaging member an environmentally friendly product. Yet another advantage is the ease of implementation by the customer, the migration imaging film of the present invention being a drop-in replacement for silver halide film.

Still another advantage to grounding methods being described is the flexibility in the manufacturing process. No substrate must be preselected for use as rolls or sheets. Various rolls or sections of rolls could be used as either sheets or rolls. The sizes of the sheets and rolls can vary depending upon customer requirements or yield requirements. Grounding contacts can be made after the entire film structure has been made.

BRIEF DESCRIPTION OF DRAWINGS

Other features of the present invention will become apparent as the following description proceeds and upon reference to the drawings, in which.

While the present invention will be described in connection with preferred embodiments thereof, it will be understood that it is not . intended to limit the invention to these embodiments. On the contrary, it is intended to cover all alternatives, modifications, and equivalents as may be included within the spirit and scope of the invention as defined by the appended claims.

DETAILED DESCRIPTION

Figure 1:
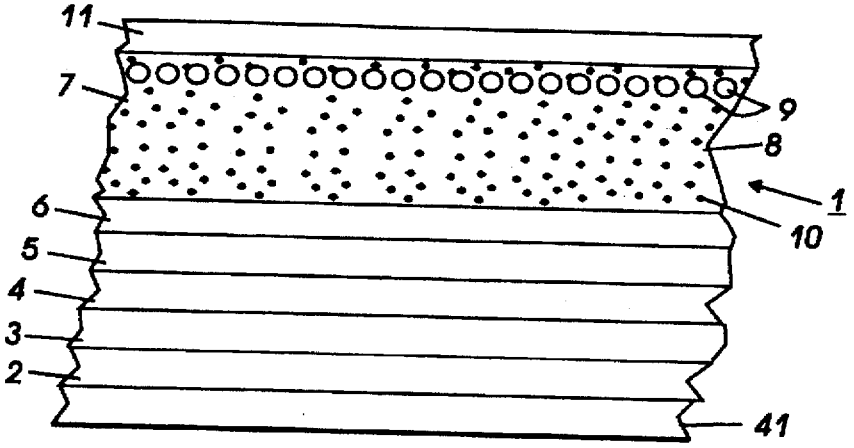
FIG. 1 illustrates schematically one migration imaging member suitable for the present invention.

An example of a migration imaging member suitable for the present invention is illustrated schematically in FIG. 1. As illustrated schematically in FIG. 1, migration imaging member 1 comprises a substrate 2, a conductive layer 3 comprising indium tin oxide dispersed in a polymeric binder, an optional adhesive layer 4, a siloxane film charge blocking layer 5, an optional charge transport layer 6, and a softenable layer 7, said softenable layer 7 comprising softenable material 8, migration marking material 9 situated at or near the surface of the layer spaced from the substrate, and optional charge transport material 10 dispersed throughout softenable material 8. Optional overcoating layer 11 is situated on the surface of softenable layer 7 spaced from the substrate 2. Optional antistatic coating 41 is situated on the surface of substrate 2 opposite to that coated with softenable layer 7. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating, with transparent materials being preferred. The substrate can be of any suitable material, such as glass, plastic, polyesters such as Mylar® (available from Du Pont) or Melinex® 442 (available from ICI Americas, Inc.), polyethylene terephthalate, and the like. The substrate has any effective thickness, typically from about 6 to about 250 microns, and preferably from about 50 to about 200 microns, although the thickness can be outside these ranges.

The conductive layer comprises indium tin oxide dispersed in a polymeric binder. Any suitable or desired binder may be selected. Examples of suitable polymeric binders include gelatin, polyvinyl alcohol, polyvinyl acetate, carboxylated polyvinyl acetate, polyvinyl acetal, polyvinyl chloride, polyvinyl phthalate, polyvinyl methyl ethyl maleic anhydride, polymethylmethacrylate, polyvinyl acetal phthalate, polystyrenebutadiene-acrylonitrile, polyvinyl butyral, polystyrene-maleic acid, polyvinylidene chloride-acrylonitrile, polymethylmethacrylate-methacrylic acid, polybutyl methacrylatemethacrylic acid, cellulose acetate, cellulose acetate-butyrate, cellulose acetate-phthalate, cellulose ethylether phthalate, methylcellulose, ethylcellulose, polymethylacrylate-vinylidene chloride-itaconic acid, poly-2-vinyl pyridine, celluloseacetate diethylamino-acetate, polyvinyl methyl ketone, polyvinyl acetophenone, polyvinyl benzophenone, polyvinylmethyl-acrylatemethacrylic acid, polyvinyl acetate maleic anhydride, polyacrylonitrile acrylic acid, poly-4-vinyl pyridine, carboxylic esters of rosin lactones, polystyrene, cellulose nitrate, polyurethane resins, polyamide resins, phenolic resins, urea resins, melamine resins, ethyl cellulose diethylaminoacetate, other basic polymers, polybasic acid polymers, polyesters, epoxy resins, alkyds, and the like, as well as mixtures thereof. The conductive layer contains indium tin oxide and the polymeric binder in any effective relative amounts. Typically, the indium tin oxide is present in an amount of from about 1 to about 30 percent by weight of the conductive layer, and preferably from about 3 to about 15 percent by weight of the conductive layer, and the binder is present in an amount of from 70 to about 99 percent by weight of the conductive layer, and preferably from about 85 to about 97 percent by weight of the conductive layer, although the amounts can be outside these ranges. Higher amounts of indium tin oxide with respect to the binder will result in greater conductivity of the coating. Indium tin oxide is commercially available, from, for example, Aldrich Chemical Co., Milwaukee, Wis. The conductive layer is of any effective or desired resistance. Typically the resistance of the conductive layer is from about $5\times10^5$ to about $2\times10^{11}$ ohm/cm$^2$, and preferably from about $5\times10^5$ to about $1\times10^7$ ohm/cm$^2$, although the resistance can be outside this range. The conductive layer is of any suitable or desired thickness; typically the conductive layer has a thickness of from about 0.4 to about 4 microns, and preferably from about 0.4 to about 1 micron, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrenevinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, William W. Limburg, John F. Yanus, Damodar M. Pal, and Dale S. Renfer, the disclosure of which is totally incorporated herein by reference.

The softenable layer of the migration imaging member optionally contains a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art.

The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The charge blocking layer comprises a siloxane or hydrolyzed silane having the general formula

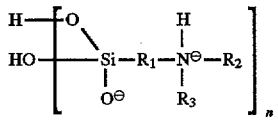

or

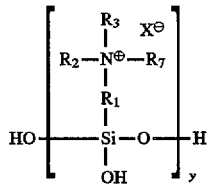

or mixtures thereof, wherein $R_1$ is an alkylidene group, preferably with from 1 to about 20 carbon atoms, $R_2$ and $R_3$ are each, independent of the other, a hydrogen atom, an alkyl group, preferably with from 1 to about 3 carbon atoms, a phenyl group, or a poly(ethylene-amino) group, $R_7$ is a hydrogen atom, an alkyl group, preferably with from 1 to about 3 carbon atoms, or a phenyl group, X is an anion from an acid or acidic salt, n is 1, 2, 3, or 4, and y is 1, 2, 3, or 4. The material is formed by hydrolyzing a hydrolyzable silane having the general formula

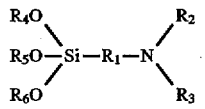

wherein $R_1$ is an alkylidene group, preferably with from 1 to about 20 carbon atoms, $R_2$ and $R_3$ are each, independent of the other, a hydrogen atom, an alkyl group, preferably with from 1 to about 3 carbon atoms, a phenyl group, or a poly(ethylene-amino) group, and $R_4$, $R_5$, and $R_6$ are each, independent of the others, alkyl groups, preferably with from 1 to about 4 carbon atoms. Examples of hydrolyzable silanes include 3-aminopropyl triethoxy silane, N-aminoethyl-3-aminopropyl trimethoxy silane, 3-aminopropyl trimethoxy silane, (N,N'-dimethyl-3-amino) propyl triethoxysilane, (N,N'-diethyl-3-amino) propyl trimethoxysilane, N,N'-dimethylamino phenyl triethoxy silane, N-phenyl aminopropyl trimethoxy silane, N-methyl aminopropyl trimethoxy silane, trimethoxy silylpropyldiethylene triamine, bis (2-hydroxyethyl) aminopropyl triethoxy silane, N-trimethoxysilyl propyl-N,N-dimethyl ammonium acetate, N-trimethoxysilylpropyl-N,N,N-trimethyl chloride, and the like. Specific examples of materials suitable for the charge blocking layer include 3-aminopropyl triethoxy silane (gamma APS), 3-aminopropyl trimethoxy silane, both available from Aldrich Chemical Co., Milwaukee, Wis., and the like. Further information regarding charge blocking materials of this type is disclosed in, for example, U.S. Pat. No. 4,464,450, the disclosure of which is totally incorporated herein by reference.

The silane is hydrolyzed by admixing the silane with sufficient water to hydrolyze the alkoxy groups attached to the silicon atom. The aqueous solution formed thereby can be coated onto the imaging member. Preferred solutions contain from about 0.05 to about 1.5 percent by weight silane, although the amount can be outside this range. The solution preferably is maintained at a pH of from about 4 to about 10. Preferred reaction temperatures are from about 100 to about 150° C., although the temperature can be outside this range. The hydrolyzed silane can also be applied to the migration imaging member in another solvent, such as methanol, ethanol, water, or the like, as well as mixtures thereof.

Any desired or suitable technique can be used to apply the hydrolyzed silane solution to the imaging member. Typical application techniques include draw bar coating, spray coating, extrusion, dip coating, gravure roll coating, wire-wound rod coating, air knife coating, and the like. Alternatively, the unhydrolyzed silane can be applied to the imaging member, followed by hydrolysis of the silane by any desired method, such as treatment with water vapor or the like. Drying of the hydrolized silane preferably is carried out at temperatures above room temperature. After drying, the siloxane reaction product film formed from the hydrolyzed silane contains larger molecules, in which n is equal to or greater than 6; the reaction product of the hydrolyzed silane may be linear, partially crosslinked, a dimer, a trimer, or the like. The charge blocking layer is of any effective thickness, typically from about 0.005 to about 2 microns, and preferably from about 0.025 to about 1 micron, although the thickness can be outside these ranges.

Figure 2:
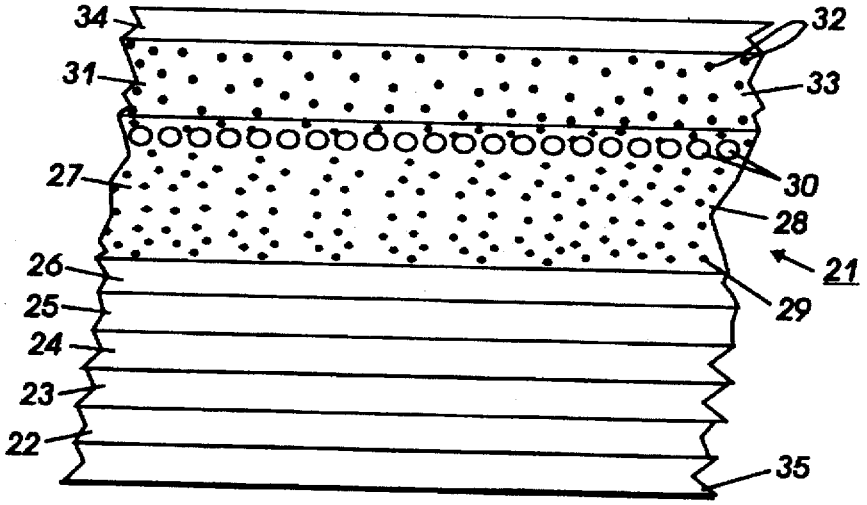
FIG. 2 illustrates schematically an infrared or red-light sensitive migration imaging member suitable for the present invention.

As illustrated schematically in FIG. 2, migration imaging member 21 comprises in the order shown a substrate 22, a conductive layer 23 comprising indium tin oxide dispersed in a polymeric binder, an optional adhesive layer 24, a siloxane film charge blocking layer 25, an optional charge transport layer 26, a softenable layer 27, said softenable layer 27 comprising softenable material 28, charge transport material 29, and migration marking material 30 situated at or near the surface of the layer spaced from the substrate, and an infrared or red light radiation sensitive layer 31 situated on softenable layer 27 comprising infrared or red light radiation sensitive pigment particles 32 optionally dispersed in polymeric binder 33. Alternatively (not shown), infrared or red light radiation sensitive layer 31 can comprise infrared or red light radiation sensitive pigment particles 32 directly deposited as a layer by, for example, vacuum evaporation techniques or other coating methods. Optional overcoating layer 34 is situated on the surface of imaging member 21 spaced from the substrate 22. Optional antistatic layer 35 is situated on the surface of substrate 22 opposite to that coated with softenable layer 27.

Figure 3:
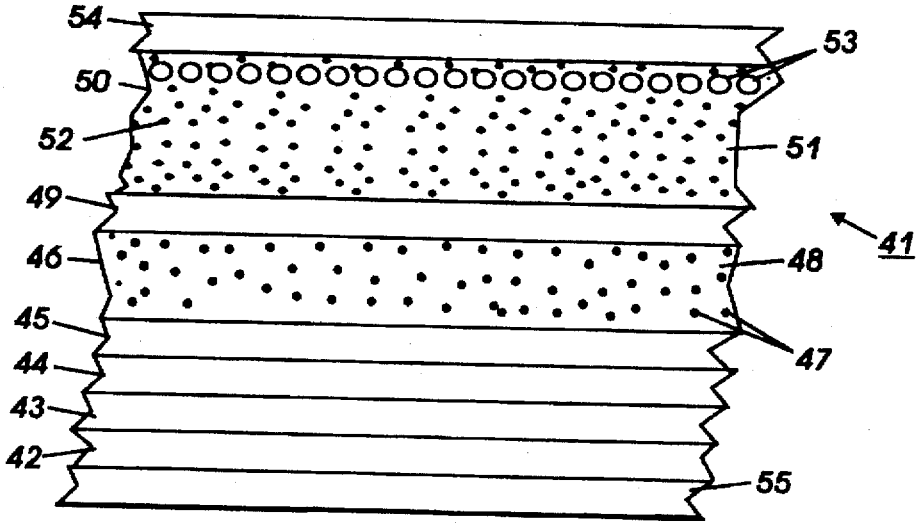
FIG. 3 illustrates schematically another infrared or red-light sensitive migration imaging member suitable for the present invention.

As illustrated schematically in FIG. 3, migration imaging member 41 comprises in the order shown a substrate 42, a conductive layer 43 comprising indium tin oxide dispersed in a polymeric binder, an optional adhesive layer 44, a siloxane film charge blocking layer 45, an infrared or red light radiation sensitive layer 46 comprising infrared or red light radiation sensitive pigment particles 47 optionally dispersed in polymeric binder 48, an optional charge transport layer 49, and a softenable layer 50, said softenable layer 50 comprising softenable material 51, charge transport material 52, and migration marking material 53 situated at or near the surface of the layer spaced from the substrate. Optional overcoating layer 54 is situated on the surface of imaging member 41 spaced from the substrate 42. Optional antistatic layer 55 is situated on the surface of substrate 42 opposite to that coated with softenable layer 50.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvat 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The optional overcoating layer can be substantially electrically insulating, or have any other suitable properties. The overcoating preferably is substantially transparent, at least in the spectral region where electromagnetic radiation is used for imagewise exposure steps in the imaging process. The overcoating layer is continuous and preferably of a thickness up to about 3 microns. More preferably, the overcoating has a thickness of between about 0.5 and about 2 microns to minimize residual charge buildup. Overcoating layers greater than about 3 microns thick can also be used. Typical overcoating materials include acrylic-styrene copolymers, methacrylate polymers, methacrylate copolymers, styrenebutylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have abhesive properties at its outer surface which provide improved resistance to toner filming during toning, transfer, and/or cleaning. The adhesive properties can be inherent in the overcoating layer or can be imparted to the overcoating layer by incorporation of another layer or component of abhesive material. These adhesive materials should not degrade the film forming components of the overcoating and preferably have a surface energy of less than about 20 ergs/cm$^2$. Typical adhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, and after the members have been imaged.

The optional antistatic layer generally comprises a binder and an antistatic agent. The binder and antistatic agent are present in any effective relative amounts, typically from about 1 to about 30 percent by weight antistatic agent and from about 70 to about 99 percent by weight binder, although the relative amounts can be outside this range. Typical thicknesses for the antistatic layer are from about 0.4 to about 2 microns, and preferably from about 0.4 to about 1 micron, although the thickness can be outside these ranges. The antistatic layer can be applied to the imaging member by any desired method, such as draw bar coating, spray coating, extrusion, dip coating, gravure roll coating, wire-wound rod coating, air knife coating, and the like. In one preferred method, the antistatic layer is coated onto the imaging member by a slot extrusion process, wherein a flat die is situated with the die lips in close proximity to the web of the substrate to be coated, resulting in a continuous film of the coating solution evenly distributed across one surface of the sheet, followed by drying in an air dryer at 100° C.

Imaging members of the present invention are exposed and developed by known processes, such as those disclosed in, for example, U.S. Pat. No. 5,215,838 (Tam et al.), the disclosure of which is totally incorporated herein by reference. In one embodiment of the present invention the imaging member can be developed by a process which comprises uniformly charging the imaging member, exposing the charged member to activating radiation at a wavelength to which the migration marking material is sensitive in an imagewise pattern, thereby forming an electrostatic latent image on the imaging member, and thereafter causing the softenable material to soften, thereby enabling the migration marking material to migrate through the softenable material toward the substrate in an imagewise pattern. In embodiments of the present invention wherein the migration imaging member contains an infrared or red light sensitive material, the member can be developed by a process which comprises uniformly charging the imaging member, exposing the charged imaging member to infrared or red light radiation at a wavelength to which the infrared or red light radiation sensitive pigment is sensitive in an imagewise pattern, thereby forming an electrostatic latent image on the imaging member, uniformly exposing the imaging member to activating radiation at a wavelength to which the migration marking material is sensitive, and causing the softenable material to soften, thereby enabling the migration marking material to migrate through the softenable material toward the substrate in an imagewise pattern.

FIGS. 4–8 show particular embodiments of electrical contacts used in the present invention. The migration imaging member shown in these drawings is the migration imaging member shown in FIG. 1, however the electrical grounding systems depicted in these drawings may be applied to any migration imaging member. An electrical ground 150 has been added to FIGS. 4–8. The electrical ground may take many forms, for example, an imaging table or rollers, depending upon the type of imaging architecture used.

Figure 4:
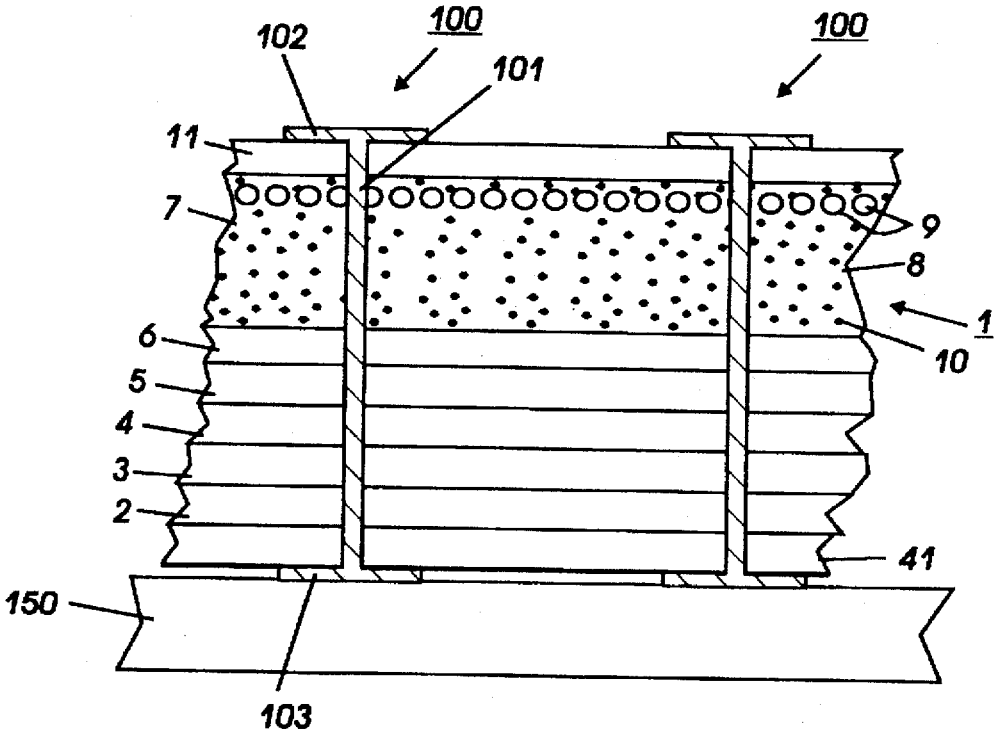
FIG. 4 is a cross-sectional view of a first electrical contact embodying the present invention for migration imaging members.

FIG. 4 shows an electrical contact 100 with top element 102 and bottom element 103 connected by solid element 101. Electrical contact 100 is in the form of a rivet and may be applied to the migration imaging member by any well-known riveting application process. Examples of materials to be used for the rivet contact 100 are electrically conductive metals such as aluminum, copper, indium, etc.

Figure 5:
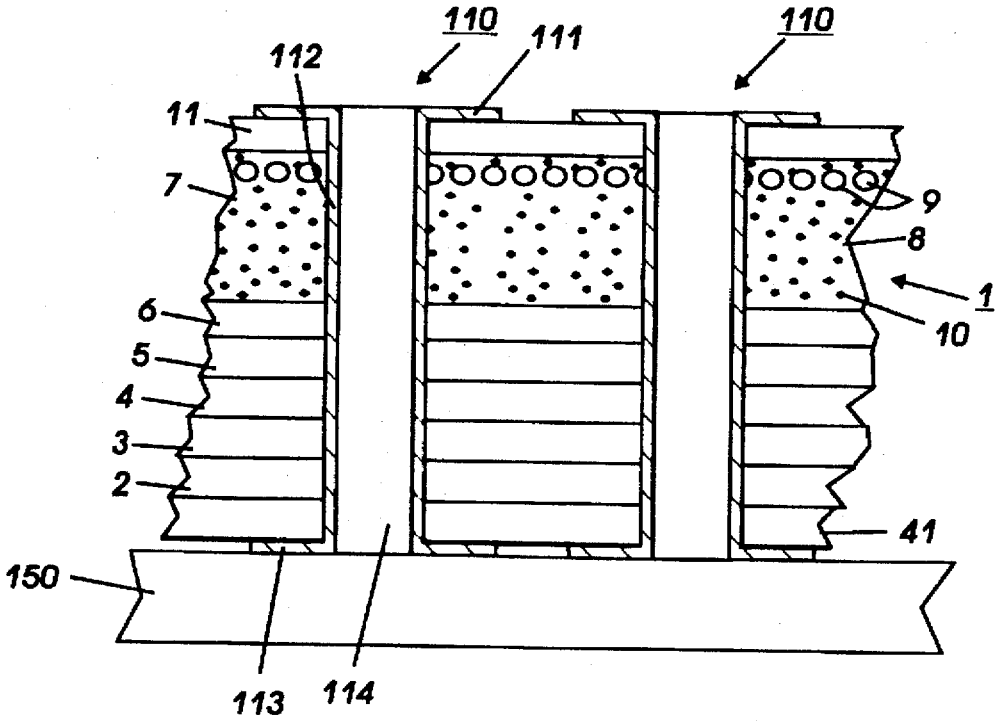
FIG. 5 is a cross-sectional view of a second electrical contact embodying the present invention for migration imaging members.

FIG. 5 shows an electrical contact 110 which is similar to that of FIG. 4, however electrical contact 110 has a hollow intermediate element 112 with a top element 111 and a bottom element 113 and a hole 114 extending therethrough. Electrical contact 110 may be formed of any electrically conductive metal, again such as aluminum, copper, indium, etc.

Figure 6:
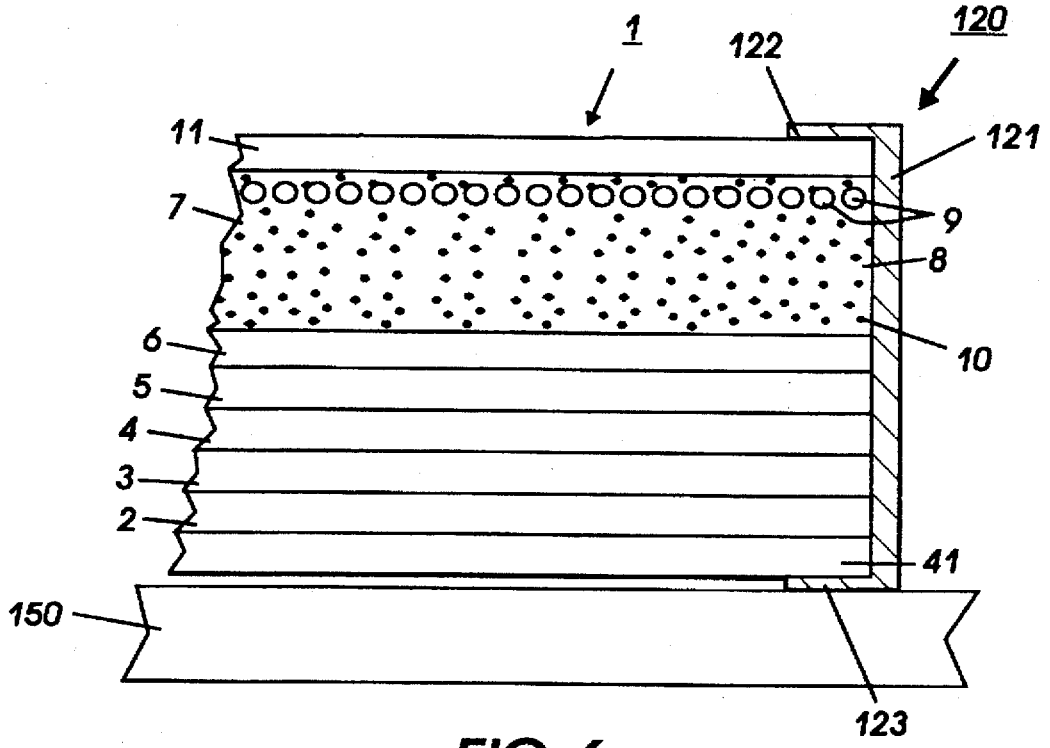
FIG. 6 is a cross-sectional view of a third electrical contact embodying the present invention for migration imaging members.

FIG. 6 depicts yet another way to electrically connect the layers of the migration imaging members. In this embodiment, electrical contact 120 is formed of conductive paint, lacquer or tape. Electrical contact 120 has a top element 122, an intermediate element 121, and bottom element 123 fixed respectively on the top, side and bottom of the migration imaging member. Electrically conductive paints such as SPI Supplies Conductive Carbon Paint, West Chester Pa. 19381, Silver Print Conductive Paint, GC Electronics, Rockford Ill., 61102, Xerox Groundstrip Solution. The paints, however, are not limited to these examples. Conductive silver, carbon or copper epoxies, cements and lacquers could also be used. An example of conductive tape which may be used is carbon based tape supplied by Adhesive Research, Inc., Glen Rock, Pa. 17327, Model #8010.

Figure 7:
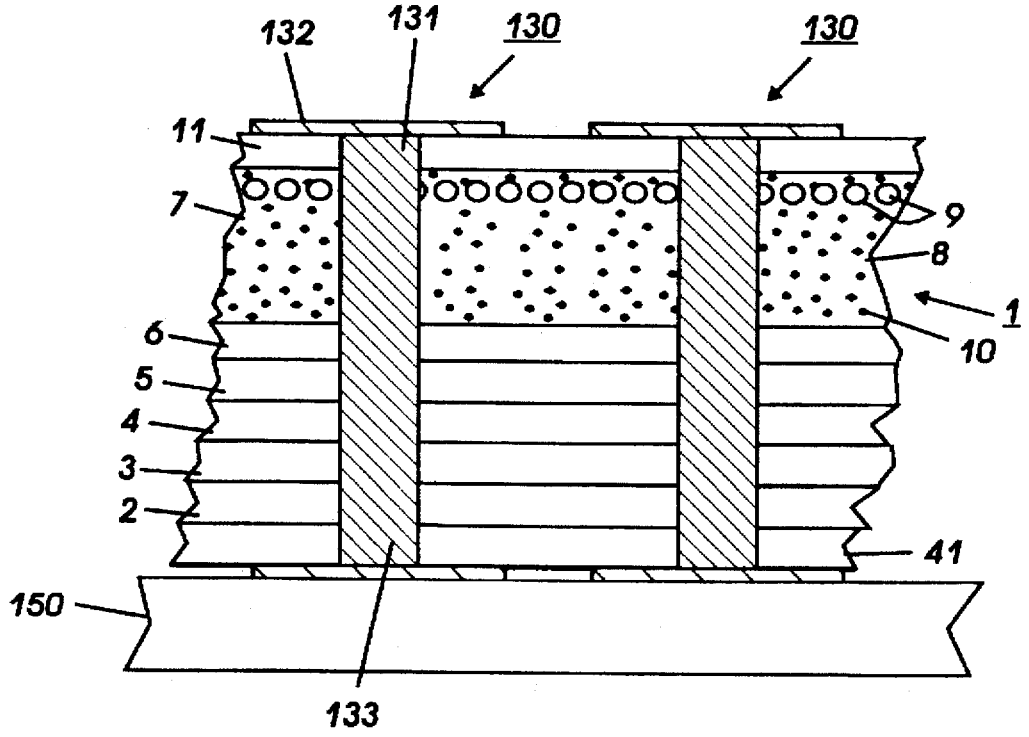
FIG. 7 is a cross-sectional view of a fourth electrical contact embodying the present invention for migration imaging members.

FIG. 7 shows electrical contact 130 formed of a conductive paste element 131 that fills a hole punched between the top and bottom surfaces of the migration imaging member. Elements 132 and 133 are tape which seal the paste element 131 in the hole. Electrically conductive pastes which are suitable for use are SPI Supplies Conductive Carbon Paste, SPI Silver Paste.

Figure 8:
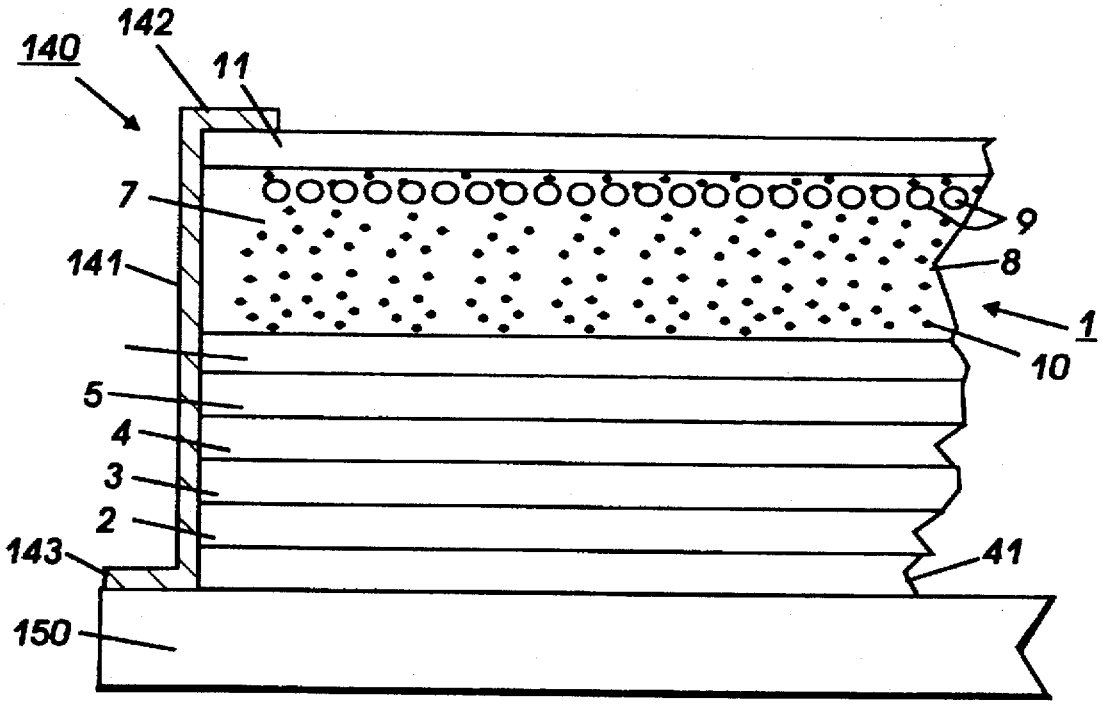
FIG. 8 is a cross-sectional view of a fifth electrical contact embodying the present invention for migration imaging members.

FIG. 8 is another way of forming a ground in a migration imaging member. In this embodiment, conductive tape 140 is applied to the migration imaging member with top 142, intermediate 141 and bottom 143 tape portions connecting the migration imaging member to the ground plane 150. This configuration results in a successfully grounded migration imaging member. The same Adhesive Research, Inc. #8010 tape may be used as described with regards to FIG. 6.

All of the above described electrical contacts have the advantage of allowing the migration imaging member to be imaged edge to edge. Having multiple electrical contacts disbursed throughout the migration imaging member allows the member to be cut to dimensions other than the 60 inch web in which the member is produced. When the electrical contact is in the form of paint or tape, the migration imaging member can be cut to the desired size and the paint or tape can then be applied.

Experimental work has shown that one electrical contact per a 100 foot long roll by 60 foot wide migration imaging member results in good imaging quality. Depending upon the size/shape of the migration imaging member and position of the ground plane contact, one contact per migration imaging member should be sufficient. Additional contacts could be used to provide backup or failsafe protection with respect to grounding. Most of the positioning and number of contacts per migration imaging member would depend on the imaging machine architecture or market segment for the migration imaging member use.

It should be appreciated that the electrical grounding contact could also be fixed to the migration imaging member before the softenable layer is applied. The electrical contact would extend from the side of the substrate opposite the side on which softenable layer is to be applied, through the substrate to the conductive layer, the electrical contact being exposed to contact the electrical ground.

EXAMPLES

Example 1

Imaging Tests

The migration imaging member structures used for this test are similar to that shown in FIG. 1 with an overcoat of SUPER CLEAR 106, two softenable layers comprised of a selenium monolayer and matrix polymer, each layer being 2 microns thick, a charge blocking and adhesive layer, a conductive layer, a substrate and an antistat layer. Several different grounding techniques were attempted in these trials. The films were processed with a charge table current set to −40 microamps, corotron height at 6.33 mm, table speed set to 88 inches/minute. A blue exposure (480 nm) of 48 ergs/cm$^2$ through silver halide target provided the image. The image was processed at 115 C. for five seconds on an aluminum heat block. The test results are shown in Table 1.

TABLE 1

| | | Blue O.D. | |
|---|---|---|---|
| Sample # | −ve charge (V) | $D_{min}$ | Contrast |
| A | −545 | 0.71 | 1.77 |
| B | −780 | 2.46 | 0.06 |
| C | −845 | 2.52 | 0.04 |
| D | −380 | 0.81 | 1.68 |
| E | −530 | 0.73 | 1.74 |
| F | −580 | 0.69 | 1.81 |

Sample A: Standard procedure for ground connection using copper tape connected to the exposed conductive layer/substrate. No arcing during charging. Low $D_{min}$ optical density and good contrast for migration imaging film structure.

Sample B: No grounding contact between the migration imaging member ground plane and the machine ground. Arcing occurred during charging: High Drain optical density and poor contrast between Dmin and Dmax regions for migration imaging film structure.

Sample C: Unsuccessful grounding attempt by using a thumb tack and pushing a hole through the migration imaging member through to a ground. Some conductive layer may be pushed through to the antistat layer but a reliable electrical connection was not established. Arcing occurred during charging. High $D_{min}$ optical density and poor contrast between $D_{min}$ and $D_{max}$ regions for migration imaging film structure.

Sample D: Using new ground technique shown in FIG. 4. No arcing during charging and good resultant images. A low $D_{min}$ density and good contrast.

Sample E: Using new grounding technique shown in FIG. 6. No arcing during charging and good resultant images. A low $D_{min}$ density and good contrast.

Sample F: Using new grounding technique shown in FIG. 7. No arcing during charging and good resultant images. A low $D_{min}$ density and good contrast.

Example 2

Resistance Measurements

The migration imaging member of Sample E was used for the resistance measurement tests. The migration imaging member was punched with a three hole punch and aluminum tape was placed on the back surface and a drop of conductive carbon paint placed in the holes on top of the tape. Another piece of aluminum tape was placed on top of the member and paint combination to seal the hole. Resistance was measured across the top surface of the migration imaging member between two of the three hole punches to determine if contact with the conductive layer was established.

For these resistance measurements several combinations of conductive and antistat layers were investigated. The migration imaging film coated on top of the conductive layer which rests on top of an optical grade polyester base and may contain an antistat coating on the backside is shown as migration imaging film/conductive/polyester/antistat. The two coatings tested are the aluminized layer and the SUPER CLEAR 106 (SC106) coating. The test resuslts are shown in Table 2.

TABLE 2

| Sample | Resistance across top surface between two hole punches (4 inches) |
|---|---|
| Top surface of Super Clear 106 with no tape or paint connection | 6 Mega ohms |
| Top surface of Verde film with no tape or paint connection | >30 Mega ohms (off scale) |
| Top surface of Verde film with tape but no paint connection | >30 Mega ohms (off scale) |
| Verde film/SC106/polyester/SC106 | 5 Mega ohms |
| Verde film/Al/polyester/SC106 | 10 Mega ohms |
| Verde film/SC106/polyester | 6 Mega ohms |
| Verde film/Al/polyester | >30 Mega ohms (off scale) |

It is, therefore, apparent that there has been provided in accordance with the present invention, new techniques and processes for establishing electrical grounding migration imaging members that fully satisfy the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A migration imaging member having a substrate, a conductive layer and a softenable layer composed of a softenable material and a photosensitive migration marking material, the member comprising:

a top surface, a bottom surface, and an edge, the softenable layer being coextensive with the conductive layer; and an electrically biasing element affixed to the migration imaging member and electrically connecting the conductive layer and the bottom surface.

2. A migration imaging member as claimed in claim 1, wherein said electrically biasing element comprises:

electrically conductive tape applied to provide electrical contact between the top surface, and the edge of the migration imaging member.

3. A migration imaging member as claimed in claim 1, including a plurality of said electrically biasing elements.

4. A migration imaging member as claimed in claim 1, wherein said electrically biasing element is integral with the migration imaging member.

5. A migration imaging member as claimed in claim 4, wherein said electrically biasing element is a layer of conductive paint deposited along the top surface, the edge and the bottom surface of the migration imaging member.

6. A migration imaging member as claimed in claim 4, wherein said electrically biasing element is conductive tape adhered to the top surface, the edge and the bottom surface of the migration imaging member.

7. A migration imaging member as claimed in claim 4, wherein said electrically biasing element extends from the bottom surface through the substrate, conductive layer and softenable layer to the top surface of the migration imaging member.

8. A migration imaging member as claimed in claim 7, wherein said electrically biasing element is a fastener.

9. A migration imaging member as claimed in claim 7, wherein said biasing element is a layer of conductive paste.

10. A migration imaging member as claimed in claim 1, further comprising:

an antistatic layer, which forms the bottom surface of the migration imaging member.

11. A method of making a grounded migration imaging member including a conductive layer located between a substrate and a softenable layer composed of a softenable material and a photosensitive migration marking material comprising the steps of:

applying the softenable layer over the conductive layer so that the softenable layer is coextensive with the conductive layer, the migration imaging member having a top surface, a bottom surface and an edge; and electrically connecting the conductive layer and the bottom surface while the softenable layer and conductive layer remain coextensive.

12. A method of making a grounded migration imaging member as claimed in claim 11, further comprising:

applying an antistatic layer to the migration imaging member, the antistatic layer being located on the bottom surface.

13. A method of making a grounded migration imaging member as claimed in claim 11, wherein the electrically connecting step further comprises:

creating an aperture through the substrate, conductive layer and softenable layer; and filling the aperture with an electrically conductive member.

14. A method of making a grounded migration imaging member as claimed in claim 13, wherein the electrically conductive member is spaced from the edge of the migration imaging member.

15. A method of making a grounded migration imaging member as claimed in claim 11, including a plurality of electrically conductive members.

16. A method of making a grounded migration imaging member as claimed in claim 15, further comprising:

cutting the migration imaging member to a desired size while maintaining at least one electrically conductive member within the migration imaging member of the desired size.

17. A method of making a grounded migration imaging member as claimed in claim 11, the electrically connecting step further comprises:

applying a conductive paint along the top surface, the edge and the bottom surface of the migration imaging member.

18. A method of making a grounded migration imaging member as claimed in claim 11, the electrically connecting step further comprises:

punching a hole through the substrate, conductive layer and softenable layer;

filling the hole with an electrically conductive paste; and sealing the hole with an electrically conductive tape.

19. A method of making a grounded migration imaging member as claimed in claim 11, the electrically connecting step further comprises:

applying electrically conductive tape to the migration imaging member so as to provide electrical contact between the top surface and the edge of the migration imaging member.

20. A method of making a grounded migration imaging member as claimed in claim 11, wherein the electrically connecting step further comprises:

applying electrically conductive tape to the migration imaging member so as to provide electrical contact between the top surface, the edge and the bottom surface of the migration imaging member.

* * * * *